United States Patent [19]

Kelly

[11] 4,148,670

[45] Apr. 10, 1979

[54] COATING SOLUTION FOR METAL SURFACE

[75] Inventor: Timm L. Kelly, Oreland, Pa.

[73] Assignee: Amchem Products, Inc., Ambler, Pa.

[21] Appl. No.: 755,922

[22] Filed: Dec. 30, 1976

Related U.S. Application Data

[63] Continuation-in-part of Ser. No. 674,015, Apr. 5, 1976, abandoned.

[51] Int. Cl.[2] ..... C23F 7/14

[52] U.S. Cl. ..... 148/6.15 R; 148/6.27

[58] Field of Search ..... 148/6.15 R, 6.15 Z, 148/6.27

[56] References Cited

U.S. PATENT DOCUMENTS

| | | | |
|---|---|---|---|
| 2,813,814 | 11/1957 | Goodspeed et al. | 148/6.15 R |
| 2,820,731 | 1/1958 | Heinzelman | 148/6.15 Z |
| 3,109,757 | 11/1963 | Reinhold | 148/6.15 Z |
| 3,682,713 | 8/1972 | Ries et al. | 148/6.14 R |
| 3,964,936 | 6/1976 | Das | 148/6.27 |
| 4,017,334 | 4/1977 | Matsushima et al. | 148/6.27 X |

FOREIGN PATENT DOCUMENTS

| | | | |
|---|---|---|---|
| 2446492 | 4/1975 | Fed. Rep. of Germany | 148/6.15 R |
| 2236907 | 7/1974 | France | 148/6.15 |
| 2246653 | 5/1975 | France | 148/6.15 |
| 2255393 | 7/1975 | France | 148/6.15 |
| 2256227 | 7/1975 | France | 148/6.15 |
| 392728 | 5/1933 | United Kingdom | 148/6.15 |
| 751189 | 6/1956 | United Kingdom | 148/6.15 |
| 764385 | 12/1956 | United Kingdom | 148/6.15 |
| 1114645 | 5/1968 | United Kingdom | 148/6.15 |

*Primary Examiner*—Ralph S. Kendall
*Attorney, Agent, or Firm*—Dale Lynn Carlson

[57] ABSTRACT

An acidic aqueous coating solution for forming on an aluminum surface a coating which is corrosion resistant and to which overlying coatings adhere excellently is disclosed. The coating solution contains compounds of zirconium and/or titanium, fluoride and phosphate in dissolved form, and optionally, polyhydroxy compounds having 6 or fewer carbon atoms. The coating solution is capable of forming on an aluminum surface a uniformly colorless and clear coating so that the coated surface has the appearance of the underlying metal surface, that is, the coating can be formed without changing the appearance of the metal surface.

44 Claims, No Drawings

COATING SOLUTION FOR METAL SURFACE

CROSS-REFERENCE TO RELATED APPLICATION

This is a continuation-in-part of co-pending application Ser. No. 674,015, filed Apr. 5, 1976 now abandoned.

FIELD OF THE INVENTION

This invention relates to the application to aluminum surfaces of coatings which are corrosion resistant and to which overlying coatings such as those formed from paints, inks and lacquers adhere excellently. More particularly, this invention relates to aqueous coating solutions which form on aluminum surfaces the aforementioned types of coatings and coating solutions which do not require the presence of toxic materials, such as chromates and ferricyanide, for their effectiveness.

It is known to coat aluminum surfaces with aqueous coating solutions that are effective in forming thereon coatings which are corrosion resistant and thereby protect the surface from degradation due to attack by corrosive materials. In general, the coatings formed from such coating solutions should also have properties such that overlying coatings which are applied thereto adhere tightly and strongly. Such overlying coatings are decorative or functional in nature and are formed from materials such as paints, lacquers, inks, etc. (hereinafter referred to as "siccative coatings").

An example of an aluminum coating operation, and one in which the present invention has particularly good applicability, is the coating of aluminum cans. In general, the corrosion resistant and adherent coatings which are applied to aluminum cans should also be uniformly clear and colorless so that the coated cans have the bright shiny natural appearance of the underlying aluminum. This bright shiny natural appearance is desired in the final product even though portions of the can may be covered with colored paints or inks. (It is noted that there are other aluminum coating operations in which it is desired that the corrosion resistant and adherent coating imparts to the aluminum surface a colored appearance, for example, a yellowish to green tint. However, this is not generally desired when coating aluminum cans.)

Another specific property that coated aluminum cans should have is the ability to resist discoloration when the coated can is subjected to moderately hot water, for example, water having a temperature within the range of about 140° F. to about 170° F. By way of background, it is noted that in certain applications, aluminum cans are so treated. (The can industry generally refers to this process as "pastuerization" of the cans.) This treatment has a tendency to cause an uncoated or even a coated aluminum surface to blacken or otherwise discolor thereby leaving the can with an unattractive appearance. In general, when the term "corrosion resistance" is used in the industry in connection with coatings for aluminum cans, it includes within its meaning that the coated surface resists blackening or other discoloration when subjected to pastuerization. The term "corrosion resistance" is so used herein unless otherwise specifically stated.

There are available presently coating solutions which form on aluminum surfaces uniformly clear colorless coatings. One of the most widely used coating solutions, which forms such coatings, contains chromatic acid, phosphoric acid and hydrofluoric acid. While such a coating solution is capable of forming coatings of the type desired, their use creates waste disposal problems because of the presence therein of hexavalent chromium, a very toxic material. It would be of great advantage to users of such coating solutions to have available coating solutions which do not contain hexavalent chromium.

This invention relates to the provision of an aqueous coating solution which does not require the use of hexavalent chromium and which is capable of forming on an aluminum surface a coating, including particularly a coating which is uniformly clear and colorless in appearance, and which is corrosion resistant and to which overlying coatings adhere excellently.

REPORTED DEVELOPMENTS

There has been developed a number of types of aluminum coating solutions for various purposes.

U.S. Pat. No. 3,682,713 discloses an aqueous coating solution containing a complex fluoride such as fluorides of boron, titanium, zirconium or iron, free fluoride ions, and an oxidizing agent such as sodium nitrobenzene sulfonate or nitrate. The patent discloses that the coating solution forms on aluminum coatings which are dull, light grey to yellowish iridescent. It is noted that the patent specifically excludes the use in the coating solution of even small quantities of phosphoric acid or phosphates because such materials are said to interfere with the formation of the coating.

U.S. Pat. No. 3,066,055 discloses coating solutions which are said to form on aluminum surfaces coatings which are colorless. The coating solutions contain fluoride compounds, including simple fluorides, complex fluorides or double metal fluorides, along with hexavalent chromium, ferrycyanide, molybdate or tungstate, and also a cation selected from elements 23 to 29 of the Periodic Table. It is noted that this patent also discloses that phosphoric acid or salts thereof, are not suitable for use in the solution.

In U.S. Pat. No. 3,160,506, there is disclosed an aqueous coating solution containing a transition metal fluoride which is said to be effective in forming on aluminum printing plates coatings which are stable under relatively high humidity and temperature conditions. There is no disclosure in this patent concerning the color of the coatings formed or the degree of corrosion resistance imparted by the coatings to the aluminum surface. It is noted that this patent discloses that the treated surface is sealed by contacting it with a chromic acid solution. See also U.S. Pat. No. 2,825,697 which discloses an aqueous coating solution which forms on an aluminum surface coatings which are said to be substantially colorless. The coating composition described in this patent is an aqueous solution containing hexavalent chromium and a complex fluorine-bearing compound such as fluosilicic acid, fluoboric acid, fluozirconic acid, fluostannic acid, fluotitanic acid or soluble salts thereof.

The following patents disclose coating solutions which are said to form colored coatings on aluminum surfaces. U.S. Pat. No. 1,638,273 discloses an aqueous coating solution containing a soluble fluosilicate, a salt of a nonferrous, iron-group metal and an alkali salt. The patent reports that the coatings formed from such coating solutions are mottled, speckeled or spotted in appearance. U.S. Pat. No. 1,710,743 discloses aqueous coating solutions containing double metal fluoride compounds such a sodium zirconium fluoride, sodium titanium fluoride and potassium titanium fluoride. The coatings formed from such solutions are said to be of varying color (for example, grey, yellowish, golden, reddish and black), depending on the particular aluminum alloy being coated and the particular ingredients and amounts thereof comprising the solution. U.S. Pat. No. 2,276,353 discloses aqueous coating solutions containing hydrofluosilic acid or salts thereof, an oxidizing agent and optionally an accelerating agent such as nitrate. The patent discloses the formation on aluminum surfaces of coatings which are grey, brown, white or reddish purple, depending on the specific ingredients and amounts thereof comprising the solution.

In the overall picture, the aforementioned patents disclose aqueous coating solutions which contain hexavalent chromium or other troublesome materials or which form coatings which require the use of a hexavalent chromium post treatment, or they disclose coating solutions which are said to form colored coatings on aluminum surfaces.

Accordingly, it is an object of the present invention to provide a coating solution which does not require the use of hexavalent chromium or similarly toxic materials, and which will form on an aluminum surface a clear and colorless coating to provide a coated surface which resists blackening or other discoloration even after being subjected to boiling water.

BRIEF DESCRIPTION OF THE INVENTION

In accordance with this invention, there is provided an aqueous treatment or coating solution which contains as essential ingredients zirconium and/or titanium, fluoride and phosphate in dissolved form. Such solutions can be used to treat a bright shiny aluminum surface in a manner such that the bright shiny appearance of the surface is not changed, while forming on the surface a uniformly colorless coating which is corrosion resistant and to which overlying coatings adhere excellently.

The corrosion resistant properties of coatings formed from coating solutions within the scope of the present invention include the ability of the coating to withstand blackening or other discoloration when subjected to boiling water for a period of time of at least about 2 minutes, and as will be seen from examples reported below, solutions can be formulated which resist blackening or other discoloration satisfactorily when exposed to boiling tap water for as long as 15 minutes, and even up to about 30 minutes.

The coating solution of the present invention is capable of effectively forming the aforementioned types of coatings on an aluminum surface in the absence of toxic materials and materials of the type which create waste disposal problems, including, for example, hexavalent chromium and elements such as manganese, iron, cobalt, nickel, molybdenum and tungsten, and also materials such as ferricyanide and ferrocyanide. Accordingly, it is not necessary, to add to the coating solution of the present invention materials, which if added, would mandate that effluents comprising the solution be treated specially before the effluent is discharged to the environment or to a sewage disposal plant.

The overall excellent results achieved from the use of the composition are surprising in view of previous teachings that the use of phosphoric acid or phosphates in aqueous zirconium or titanium coating compositions adversely affects the coating properties thereof. It is noted that zirconium or titanium phosphate is highly insoluble in aqueous medium. (A known analytical test for determining the amount of zirconium or titanium in aqueous solution includes the introduction into the solution of phosphate to precipitate zirconium or titanium phosphate.) Previous work which has involved the formulation and use of an aqueous composition containing zirconium, fluoride, and phosphate to form coatings on aluminum of the type to which this invention relates have been carried out under conditions which resulted in the formation of zirconium phosphate precipitate, which, as explained in detail below, is highly undesirable in an industrial coating operation. As will be described in detail below, the composition of the present invention is formulated under conditions such that the aqueous coating solution of the invention contains substantially no solids of zirconium or titanium phosphate which tend to precipitate.

As will be explained in detail below, another aspect of the present invention relates to the use of a replenishing composition for maintaining the effective operation of a coating bath as it is used continuously to coat aluminum articles.

DETAILED DESCRIPTION OF THE INVENTION

The coating solution of the present invention can be used to coat surfaces of pure aluminum or alloys of aluminum, for example, aluminum alloys containing minor amounts of metals such as, for example, magnesium, manganese, copper and silicon. Presently, the most popular alloy used in the aluminum can industry is aluminum alloy 3004. It is believed that one of the widest uses of the coating solution of the present invention will be the coating of aluminum surfaces which have a bright shiny appearance. Aluminum cans and aluminum strip are examples of articles that can be treated effectively with the composition of this invention.

The acidic aqueous coating solution can be prepared from a variety of compounds which contain the aforementioned essential ingredients (zirconium and/or titanium, fluoride and phosphate) and which are soluble in the solution. As to the source of the zirconium and/or titanium, there can be used soluble fluozirconate and/or fluotitanate compounds such as, for example, acids (fluozirconic and fluotitanic) thereof and ammonium and alkali metal fluozirconates and fluotitanates. The coating solution can also be prepared from zirconium fluoride ($ZrF_4$) and/or titanium fluorides ($TiF_3$, $TiF_4$). In addition, the coating solutions can be prepared from a mixture of soluble compounds, one of which contains zirconium or titanium and the other of which contains fluoride. Examples of such compounds are zirconium nitrate, zirconium sulfate, and titanium (iv) sulfate and hydrofluoric acid and water soluble salts thereof, for example, ammonium and alkali metal salts. Zirconium carbonates such as ammonium and alkali metal zirconium carbonates can also be used.

Any compound soluble in the solution and a source of phosphate can be used. For example, phosphoric acid and ammonium and alkali metal phosphates can be used. Although the use of ortho-phosporic acid is preferred, there can also be used phosphoric acid in its meta-, pyro-, tri-poly- and hypo- forms and salts thereof.

Developmental work has shown that zirconium and/or titanium must be present in the coating, that is, they must be directly or indirectly bonded to the aluminum surface in order to achieve coatings having satisfactory properties. Satisfactory coatings can be formed from coating solutions containing as little as about 10 ppm of either of these ingredients. (When utilizing a mixture of zirconium and titanium, the total of the amounts of zirconium and titanium should be at least about 10 ppm.) However, as will be explained below, greater amounts of these ingredients may be required to produce satisfactory coatings depending on other parameters of the coating process.

Zirconium and/or titanium can be used in amounts up to their solubility limits in the acidic aqueous coating solution. The solubility limits of the ingredients will depend on other parameters of the coating solution, including particularly, the acidity of the coating solution, the amount of fluoride in the coating solution, and the amount of phosphate present in the coating solution. These parameters should be controlled so that the formation of zirconium and titanium phosphate precipitate is avoided. The formation of such precipitate is undesirable for several reasons. Precipitation depletes the amounts of the ingredients. Also, the deposition on the coated aluminum surface of precipitate can adversely effect the coating properties. In addition, the formation and accumulation of any type of precipitate can tend to interfere with the application of the coating solution. For example, it can clog spray nozzles. If precipitation is encountered in a specific application, the amount of phosphate should be reduced and/or the pH of the coating solution should be lowered, and/or the amount of fluoride can be increased.

As to the phosphate ingredient, it has been found that the use of phosphate in the coating solution allows the user to conduct a simple test to confirm the formation on the aluminum surface of the coating. In an industrial operation which can involve the treatment of vasts quantities of aluminum in a relatively short time, it is helpful to have a simple test to confirm that the coating solution is forming a coating since the coating is not visible to the eye. (An unnoticed change in the operating parameters of a bath of the coating solution which renders it ineffective may take place as a result of mechanical or human failure. For example, improper replenishment of the coating solution may go unnoticed.) It has been found that an aluminum surface coated with the composition of the present invention changes in color varying from light golden brown to darker shades of brown or purple when subjected to a relatively high temperature for a relatively short period of time, for example, 1000° F. for 5 minutes. Work has shown that this discoloration is indicative of the presence of zirconium and phosphorous in the coating. This test, referred to herein as the "muffle test", can be used to randomly sample treated aluminum surfaces to determine whether or not the coating solution is depositing zirconium and phosphorous on the aluminum surface. If zirconium and phosphorous are not being deposited, the aluminum surface has a dull greyish appearance after the muffle test. It is noted also that electron probe analysis of coated surfaces treated with the composition of the present invention shows the presence of both zirconium and phosphorous.

It has been found also that the use of phosphate contributes to the corrosion resistance and adherent properties of the coatings, particularly coatings formed from a coating solution having a pH below about 3.5.

Coatings having satisfactory properties and capable of discoloring when subjected to the aforementioned muffle test have been produced from coating compositions containing as little as about 10 ppm of phosphate. However, as will be explained below, greater amounts of phosphate may be required to produce satisfactory coatings depending on other parameters of the coating process.

Excess amounts of phosphate in the coating solution can lead to the formation of coatings having reduced corrosion resistant properties. In general, the phosphate concentration should be no greater than about 1000 ppm. In selecting a phosphate concentration, there should be taken into account also the guidelines set forth above in connection with the tendency of phosphate to precipitate with zirconium or titanium.

As to the fluoride concentration, the minimum concentration should be that which is sufficient to combine with all of the zirconium or titanium to form a soluble complex therewith, for example, a fluozirconate or fluotitanate. Complexing the zirconium or titanium with fluoride deters or prevents the formation of zirconium and/or titanium phosphate precipitate. Accordingly, the minimum amount of fluoride is dependent on the amount of zirconium or titanium in the solution. In general, when the amount of zirconium present in the solution is about 10 ppm, the minimum amount of fluoride is about 13 ppm. When the amount of titanium present in the solution is about 10 ppm, the minimum amount of fluoride is about 25 ppm.

Other considerations respecting the minimum fluoride concentration should be taken into account in any application in which a coating solution which has been contacted with aluminum is reused for contact with additional aluminum. By way of explanation, it is noted that the coating solution of the present invention dissolves aluminum. Thus, in an application in which the aluminum is contacted with the coating solution by immersing it in a bath of the coating solution, there is a build-up in concentration of dissolved aluminum in the bath. Similarly, if spraying or flow coating techniques are used for contacting the aluminum, and excess or unreacted solution is recycled to the bath of solution, there is a build-up of dissolved aluminum in the bath. In order to deter or prevent adverse effects on the coating process as a result of a build-up of aluminum in the coating solution, the coating solution should contain sufficient amount of fluoride to complex the dissolved aluminum. This is important for the satisfactory operation of a continuous coating process. The amount of fluoride needed will depend on the extent to which aluminum builds-up in the coating solution. And this in turn depends on various factors such as the shape of the aluminum surface being treated and the manner in which the surface is contacted with the solution.

Any material which is soluble in the coating solution and which is a source of fluoride capable of complexing aluminum and which does not contain a constituent which adversely affects the coating process can be used. However, if fluoride is added as a complex fluoride of titanium or zirconium, there should also be added to the solution another material which is a source of fluoride for complexing aluminum which builds-up as the process is continued. The amount of fluoride available from hydrolysis of such complex fluoride may not be sufficient to complex the aluminum, and the extent of hydrolysis may be such that uncomplexed zirconium or titanium combines with phosphate to form an undesired precipitate. By utilizing another material which will readily provide sufficient fluoride for complexing the aluminum, the aforementioned is avoided. Examples of such materials are hydrofluoric acid, salts thereof, $NH_4F.HF$ and alkali metal bifluorides. Hydrofluoric acid is a particularly good source of fluoride because it provides sufficient fluoride to complex the aluminum and is not a source of extraneous cations which may interfere with the coating process.

From a practical standpoint, the coating solution should contain, when operating on an industrial scale, an excess of fluoride, that is, an amount above that complexed with aluminum and any other metal constituents in the solution that form complexes with the fluoride. Such excess fluoride is referred to herein as "available fluoride" and includes fluoride present as HF and fluoride ion, that is, F not associated with other materials in the solution. The available fluoride concentration is that found when a sample of the coating solution, diluted with a constant ionic strength buffer which contains 40.8 g/l of sodium acetate, 28.5 ml/l of glacial acetic acid and 58.0 g/l of sodium chloride in deionized water and adjusted to a pH within the range of 5.0 to 5.3 with NaOH, is tested with an Orion pH meter (model No. 9409) having an Orion fluoride ion specific electrode (model No. 90-01). A coating solution which contains available fluoride is one in which fluoride is available to complex with aluminum.

The upper concentration of available fluoride is that which does not result in undue etching of the aluminum surface. Undue etching tends to produce a dull and frostly surface. It has been observed that the presence of an excess of available fluoride can adversely affect the corrosion resistant and adherent properties of the coating. The available fluoride concentration which leads to such problems can vary depending on other parameters of the coating process, including, for example, the pH of the solution and time and temperature of contact. It is recommended that the available fluoride concentration be no greater than about 500 ppm.

The pH of the coating solution should be within the range of about 1.5 to about 4.0. At higher pHs phosphate precipitation can be a problem. Preferably, a pH within the range of about 2.6 to about 3.1 is used. The pH of the solution may be adjusted by using appropriate amounts of nitric acid or ammonium hydroxide. Although nitric acid and ammonium hydroxide are recommended as pH adjusters, any acid or base which will not interfere with the coating process can be used. For example, perchloric acid or sulfuric acid can be used. When using sulfuric acid, it is recommended that the pH of the coating solution be no less than 2. Below this value, sulfuric acid can tend to adversely affect the coating operation.

With respect to optional ingredients, it has been observed that the use of fluoboric acid in the coating solution can improve the gloss or hardness of paint films which are applied to surfaces treated with the coating solution of the present invention. Also, the addition of fluoboric acid helps maintain the stability of a coating solution formulated from hard water. Calcium and magnesium ions in hard water have an affinity for fluoride. If fluoride is extracted from the zirconium and/or titanium fluoride complex by such ions, the uncomplexed zirconium and/or titanium may tend to combine with the phosphate to form insoluble zirconium and/or titanium phosphate precipitate. It is believed that fluoboric acid acts as a buffered source of fluoride for calcium and magnesium ions in hard water. An excess amount of fluoboric acid can tend to reduce the corrosion resistant properties of the coating. In general, fluoboric acid can be used in an amount within the range of about 8 to about 200 ppm.

A polyhydroxy compound may be added to the coating solution to provide coatings which have improved adhesion to paint or ink coatings. Any compound soluble in the coating solution which when dissolved yields polyhydroxy compounds having six or fewer carbon atoms and which does not interfere with the ability of the coating solution to coat or provide coatings having the desired corrosion resistance and paint adherence may be used. Examples of such compounds include gluconic acid, salts of gluconic acid, sorbitol, mannitol, dextrose, ethylene glycol, and glycerine.

Particularly preferred polyhydroxy compounds are gluconic acid and alkali metal and ammonium salts thereof. Any compound soluble in the coating solution which yields gluconate and/or gluconic acid may be used. Examples of such compounds are stable glucono-lactones such as glucono-delta-lactone and glucono-gamma-lactone.

It is recommended that at least about 40 ppm of the polyhydroxy compound be used. Although higher amounts can be used, it is recommended that the polyhydroxy compound be present in an amount no greater than about 1000 ppm. Preferably about 40 to about 400 ppm of the polyhydroxy compound are used.

The coating solution should be free of chromium and other toxic materials such as iron cyanides and any materials which form in the solution solids which tend to precipitate.

A particularly preferred coating solution for use in the practice of this invention has a pH within the range of about 2.6 to about 3.1 and contains:

| Ingredient | Approximate Concentration in ppm |
|---|---|
| Zr | 45 to 125 |
| $PO_4$ | 50 to 200 |
| Available Fluoride | 10 to 200 |

The preferred source of Zr in the above composition is ammonium fluozirconate and the preferred source of phosphate is $H_3PO_4$. Preferably hydrofluoric acid is used as the source of available fluoride, and nitric acid is used to adjust the pH. The use of about 8 to about 200 ppm of fluoboric acid and about 40 to about 400 ppm of the polyhydroxy compound, preferably gluconic acid, is advantageous for reasons mentioned above.

When utilizing titanium, it is preferably used in an amount within the range of about 20 to about 65 ppm. The preferred source of titanium is fluotitanic acid. Other of the preferred ingredients and amounts thereof are described immediately above for the preferred Zr-containing solution.

Amount ranges for ingredients comprising the composition have been described above. Considerations should be taken into account in formulating specific compositions for specific applications while working within the aforementioned ranges. When operating at a relatively high pH, relatively small amounts of zirconium or titanium and/or phosphate should be used to deter precipitation. When contacting the coating solution and the aluminum surface for a relatively short time, relatively high amounts of zirconium or titanium and phosphate should be used. Similarly, when the temperature of contact between the coating solution and the aluminum surface is relatively low, relatively high amounts of ingredients should be used. In general, the lower the amount of phosphate used in the composition, the higher the amount of zirconium and/or titanium that can be used.

The coating solution of the present invention can be prepared conveniently by diluting an aqueous concentrate of the ingredients with an appropriate amount of water. The concentrate should be such that when a coating solution comprises about 0.5 to about 10 weight percent of the concentrate, the amounts of ingredients present in the coating solution are: (A) at least about 10 ppm of zirconium or titanium; (B) at least about 10 ppm of phosphate; and (C) fluoride in an amount at least sufficient to combine with substantially all of the Zr or Ti to form a complex therewith; and the pH of the coating solution is within the range of about 1.5 to about 4.0.

A concentrate for preparing a preferred coating solution for use in the invention is such that when the coating solution comprises about 0.5 to about 10 weight percent of the concentrate, the coating solution comprises: (A) about 45 to about 125 ppm of zirconium, added as a fluozirconate such as sodium or potassium fluozirconate, most preferably ammonium fluozironate; (B) about 50 to about 200 ppm of phosphate added as $H_3PO_4$; (C) about 8 to about 200 ppm of $HBF_4$; and (D) about 10 to about 50 ppm of HF; and (E) nitric acid in an amount such that the pH of the coating solution is within the range of about 2.6 to about 3.1. A polyhydroxy compound, preferably gluconic acid, can also be included in the concentrate in an amount such that the coating solution comprises about 40 to about 400 ppm thereof.

In a continuous coating operation, it is important to properly replenish the solution in order to maintain the effectiveness of the coating process. Work done in connection with the development of the present invention has shown that various of the ingredients comprising the solution are depleted as a result of reactions which occur during the formation of the coating. (As mentioned above, analytical work has shown that zirconium and phosphorus are present in the coating.) Available fluoride is consumed as a result of complexing with aluminum, and hydrogen is consumed as the aluminum surface is oxidized. In addition, ingredients are depleted as a result of drag-out of the solution on the aluminum surface. Work has also shown that the rate of depletion of ingredients is related to the shape of the surface being coated and the manner in which the coating solution is contacted with the aluminum surface. For example, when spraying cans, there is a greater drag-out loss than when spraying strip.

The coating solution can be replenished as the ingredients are depleted. This may be replenished as the ingredients are depleted. This may be accomplished by either monitoring the amount of each ingredient in the coating solution and adding this ingredient as it is depleted or it can be accomplished by adding thereto an aqueous concentrate of the ingredients.

The replenishing ingredients should be added to the solution to maintain the ingredients thereof in effective operating amounts. In an application in which there is a buildup of aluminum in the coating solution, it is recommended that the replenishing composition contain a relatively high proportion of fluoride for complexing the aluminum. Preferred sources of available fluoride are HF or ammonium bifluoride or a mixture thereof. The following is a recommended aqueous concentrate for replenishing the coating solution.

(A) about 5 to about 10 g/l of Zr or about 2.5 to about 5 g/l of Ti;

(B) about 5 to about 10 g/l of $PO_4$; and (C) a material which is a source of about 5 to about 20 g/l of available fluoride, preferably HF or ammonium bifluoride or a mixture thereof.

When utilizing a polyhydroxy compound, it should be included in the replenishing concentrate in an amount of about 5 to about 20 g/l. When utilizing fluoboric acid, it should be included in the replenishing concentrate in an amount of about 1 to about 5 g/l.

A description of other steps that can be utilized in the overall coating process follows.

The coating solution should be applied to a clean aluminum surface. Available cleaning compositions such as alkaline or acid cleaning solutions can be used to clean the aluminum surface according to conventional techniques.

The coating solution can be applied to the aluminum surface by any suitable method. For example, the solution can be applied by spraying the aluminum surface, or the aluminum surface can be immersed in the solution, or it can be applied by roll or flow coating techniques or misting techniques. It is believed that the solution can be applied very economically by spraying. The solution can be used to coat individual articles such as, for example, cans, or it can be used to coat forms of aluminum, such as aluminum strip, which are subsequently fabricated into articles.

The temperature of the coating solution should be such that the reactive ingredients of the solution bond to the aluminum surface. While the coating solution can be applied at room temperature, in general, the temperature of the coating solution should be at least about 80° F. If the temperature of the coating solution is too high, a dull and frosty appearing surface can be obtained. The temperature at which this occurs depends on various of the parameters of the coating operation, including, for example, the time of contact of the solution with the aluminum surface and the reactivity of the solution which depends on pH and concentration of ingredients in the solution. An upper temperature limit of 150° F. is recommended. The temperature of the coating solution is preferably within the range of about 80 to about 110° F.

Desired coatings can be formed by contacting the coating solution and the aluminum surface for at least about 5 seconds, preferably at least about 15 seconds. The lower the temperature of the coating solution, the longer should be the contact time and the higher the temperature of the solution the shorter the contact time required. In general, it will be unnecessary to contact the surface with the coating solution for more than one minute.

The acidic aqueous coating solution is capable of forming a very thin and very light weight coating. The coating weight will vary depending upon the concentration of the various ingredients in the coating solution, the temperature of application, and the time of application. For uses of the type referred to herein, it is preferred that the coating have a weight of about 2 to about 20 mg/sq. ft., preferably about 5 to about 10 mg/sq. ft. Coatings have such weights can be formed by operating within the conditions described above. Higher coating weights can create problems in the aluminum can coating industry. The machinery which applies paint or ink to coated aluminum cans has precise tolerances to accommodate cans having very thin coatings. Cans with relatively thick coatings can foul the machinery.

Utilizing the coating solution of the present invention, it is possible to form coatings which are very uniform. This permits paint or ink to be applied evenly and with desired coverage to the coated aluminum surface. In the aluminum can industry, paint and ink coatings are applied to coated aluminum cans by an automatic roller coating machine in which paints and inks are applied to a roller and then to the surface of the coated can as the roller is rotated across the surface of the coated can. If the can has a non-uniform coating, the subsequently applied ink or paint composition may not cover the desired areas of the can.

After the coating solution has been applied to the aluminum surface, it should be water rinsed, including a final deionized water rinse. Rinsing with water that contains a small amount of dissolved solids may lead to a coating which has poor paint adhesive properties. In utilizing the present invention, it is not necessary to rinse the coated surface with an aqueous solution of chromium such as, for example, a hexavalent chromium solution.

After the coated surface has been water rinsed, or otherwise treated as described above, the coating should be dried. This can be done by any practical means, such as, for example, oven drying or forced circulation of hot air. Other available drying methods can be used.

After the coating has been applied, it can be subjected to sanitary or decorative coating operations which include, for example, applying to the coated surface siccative coatings. These coatings are usually applied after the aluminum surface has been coated, water-rinsed and dried. In some applications, the sanitary coating is applied after the water rinse and both the coating of the present invention and the sanitary coating are dried simultaneously.

By way of example, it is noted that in an application where aluminum cans are filled with beer, the cans are treated with the coating solution of the present invention and then sanitary and/or decorative coatings are applied. Thereafter the cans are filled with beer and sealed, after which the beer-filled cans are subjected to pasteurization.

It is believed that in coating solutions of the present invention and containing zirconium and/or titanium, fluoride and phosphate, zirconium and/or titanium is present in the solution in a complexed form which is soluble in the solution and in a form which is reactive with the aluminum surface to form thereon a coating containing zirconium and/or titanium without effecting the bright shiny appearance of the aluminum surface. Accordingly, the solution should be free of constituents which combine with zirconium and/or titanium to form zirconium and/or titanium-containing compounds and/or complexes which precipitate from the solution and/or zirconium and/or titanium-containing compounds or complexes which are not reactive with the aluminum surface or which are reactive, but in a manner such that the bright shiny appearance of the aluminum surface is altered.

EXAMPLES

Examples below are illustrative of the practice of the present invention. Comparative examples are set forth also.

Unless stated otherwise, the aluminum surfaces treated with the solutions identified in the examples were drawn and ironed aluminum cans which were first degreased, as necessary, in an acidic aqueous cleaner containing sulphuric acid and detergents. Unless stated otherwise, the coating solutions were applied by spraying for about 25 seconds at a temperature of about 110° F. After treatment with the solutions identified in the examples, the aluminum surfaces were rinsed in deionized water and dried in an oven for 2 minutes at about 400° F.

Thereafter, the aluminum surfaces were tested for corrosion resistance by subjecting them to a pasteurization test. This test consisting of immersing the aluminum surface in water having a temperature, as indicated, and for a period of time, as indicated. A cleaned-only aluminum surface, when subjected to the pasteurization test, turns black after a few minutes. It will be seen from examples set forth below that prior treatment of the aluminum surfaces with coating solutions of the present invention resulted in the provision of coated surfaces which were not blackened or otherwise discolored or which resisted blackening or other discoloration. The results of the tests were rated as follows: 5, perfect, no blackening; 3+, acceptable; and 0, total failure, severe blackening.

Aluminum surfaces treated with the solutions described in the examples were tested also for paint adhesion. After the treated surface was dried, as described above, a portion of the surface was painted with a white base coat (No. 12W100A white polyester sold by H.C.I.) and the other portion of the surface was painted with an interior vinyl-lacquer (Modified Vinyl Epoxy Lacquer C-5054 sold by Mobil). After the paint was cured, the painted surface was immersed either in boiling water-detergent or water-NaCl solution. After removing the painted surface from the solution, it was rinsed in water, and the excess water was removed from the surface by wiping. The painted surface was then cross hatched, using a sharp metal object to expose lines of aluminum which showed through the paint or lacquer, and tested for paint adhesion. This test included applying cellophane tape firmly over the cross hatched area and then drawing the tape back against itself with a rapid pulling motion such that the tape was pulled away from the cross hatched area. The results of the test were rated as follows: 10, perfect, when the tape did not peel any paint from the surface; 8, acceptable; and 0, total failure.

The various compositions of the first 6 examples and the first 7 comparative examples are listed in Table 1 below and include compositions within the scope of the invention and comparative compositions. Table 2 below lists the results of the pasteurization and paint adhesion tests. Solutions in Table 1 were adjusted to a pH of 2.7 by adding concentrated nitric acid or ammonium hydroxide. The surfaces were subjected to either boiling tap water for 15 minutes or hot tap water (160° F.) for 45 minutes, as indicated in Table 2.

In some cases, more than one sample of the aluminum surface was treated in the same way. In such cases a plurality of ratings are set forth in the tables which follow.

Table 1

| Ingredients of Solutions and Amounts Thereof in g/l | | | | | | |
|---|---|---|---|---|---|---|
| Ex. No. | $(NH_4)_2ZrF_6$ | $HBF_4$ | $H_2SiF_6$ | $H_2TiF_6$ | HF | $H_3PO_4$ |
| 1 | 0.240 | — | — | 0.164 | 0.050 | 0.294 |
| 2 | — | — | — | 0.164 | 0.050 | 0.294 |
| 3 | — | 0.264 | — | 0.164 | 0.050 | 0.294 |
| 4 | 0.240 | 0.264 | — | 0.164 | 0.050 | 0.294 |
| 5 | 0.240 | 0.264 | — | — | — | 0.294 |
| 6 | 0.240 | 0.264 | — | 0.164 | — | 0.294 |
| C-1* | 0 | 0 | 0 | 0 | 0 | 0 |
| C-2 | 0.240 | — | — | — | 0.050 | — |
| C-3 | 0.240 | 0.264 | — | — | 0.050 | — |
| C-4 | — | 0.264 | — | — | 0.050 | 0.294 |
| C-5 | 0.240 | — | 0.442 | — | 0.050 | — |
| C-6 | — | — | 0.442 | — | 0.050 | 0.294 |
| C-7 | 0.240 | — | — | 0.164 | 0.050 | — |

Table 2

| | Pasteurization Test | | Paint Adhesion Test** | |
|---|---|---|---|---|
| Ex. No. | 212° F., 15 min | 160° F., 45 min | White Base Coat | Interior Vinyl Lacquer |
| 1 | 3+ | 4− | 10,9+,9+,9 | 10,10,10,10 |
| 2 | 3 | 3 | 10,9+,9+,9 | 10,10,10,10 |
| 3 | 2 | 3− | 9,9,9,8 | 10,10,10,10 |
| 4 | 3 | 3+ | 9+,8+,8,8 | 10,10,10,10 |
| 5 | 4+ | 4+ | 10,10,9+,9 | 10,10,10,10 |
| 6 | 4+ | 4+ | 10,10,10,10 | 10,10,10,10 |
| C-1* | 0 | 0 | 0,0,0,0 | 10,10,9+,8 |
| C-2 | 0 | 0 | 9,8+,8,6 | 10,10,10,10 |
| C-3 | 0 | 0 | 6,<5,<5,0 | 10,10,10,10 |
| C-4 | 0 | 0 | 0,0,0,0 | 10,10,10,9+ |
| C-5 | 0 | 0 | 0,0,0,0 | 10,9+,9+,9+ |
| C-6 | 0 | 0 | 0,0,0,0 | 10,10,10 |
| C-7 | 0 | 0 | 7,6,<5,<5 | 10,10,10,9+ |

*Cleaned only, no treatment.
**0.7% Orvus-K detergent, 212° F., 15 minutes

The examples listed in Table 3 below illustrate the effect of varying the phosphate concentration in fluozirconate solutions. The solutions of these examples had a pH of 2.5, except that of Example C-9 which had a pH of 3.25. The pasteurization test involved immersion of an unpainted aluminum can dome in tap water (160° F.) for 45 minutes. Paint adhesion of both white base coat and interior vinyl lacquer was tested by immersion of painted cans in a boiling 1% detergent (Joy solution) for 15 minutes followed by the standard cross hatching and taping.

Table 3

| Ingredients of Solutions and Amounts Thereof in g/l | | | | | | |
|---|---|---|---|---|---|---|
| | | | | | Paint Adhesion Test | |
| Ex. No. | $H_3PO_4$ | $(NH_4)_2ZrF_6$ | HF | Pasteurization Test | White Base Coat | Interior Vinyl Lacquer |
| C-8 | 0 | 0.24 | 0.05 | 0 | 8,7,0,0 | 10,10,10 |
| 7 | 0.05 | 0.24 | 0.05 | 3 | 9+,9+,9,9 | 10,10,10,10 |
| 8 | 0.10 | 0.24 | 0.05 | 4− | 9+,8+,8,5 | 10,10,10,10 |
| 9 | 0.49 | 0.24 | 0.05 | 4− | 9+,9+,9,9 | 10,10,10,10 |
| 10 | 0.98 | 0.24 | 0.05 | 3+ | 9+,9+,9+,9+ | 10,10,10,10 |
| C-9 | 0.98 | 0 | 0.05 | 0 | 0,0 | 10,7 |

EXAMPLE 11

This example illustrates the use of a make-up solution and a replenishing solution in a continuous can coating process in which 400 cans were coated. The make-up concentrate contained 4.8 g/l of ammonium fluozirconate, 3 g/l of phosphoric acid, 0.44 g/l of hydrofloric acid, 2.64 g/l of fluoboric acid, 11.4 g/l of nitric acid, and 1.92 g/l of sodium gluconate. This make-up concentrate was then diluted to 2.5% in an aqueous solution. The pH of the solution was 2.70. The replenishing solution was made up of 24 g/l of ammonium fluozirconate, 9.4 g/l of phosphoric acid, 11.7 g/l of hydrofluoric acid, 0.68 g/l of fluoboric acid, 21.4 g/l of nitric acid, and 0.4 g/l of sodium gluconate.

As the aluminum cans were processed, replenishing solution was added, as needed, to maintain the bath at a pH of 2.70±0.02. (The pH was checked after every 10 cans were coated. Subsequent calculations showed that an average of about 0.3 ml of replenishing solution per can was used.) The pasteurization test involved immersion in boiling tap water for 15 minutes. Paint adhesion was tested by immersion in boiling water with 0.7% detergent (Orvus K) for 15 minutes, followed by cross hatching and taping. Test results are shown in Table 4 below.

Table 4

| | | Paint Adhesion Test | |
|---|---|---|---|
| Number of Cans Processed | Pasteurization Test | White Base Coat | Interior Vinyl Lacquer |
| 1 | 3 | 10,10 | 10,10 |
| 50 | 4+ | 10,10 | 10,10 |
| 51 | 4+ | 10,10 | 10,10 |
| 100 | 4+ | 10,8+ | 10,10 |
| 101 | 3 | 8+,7 | 10,10 |
| 150 | 4+ | 9+,8 | 10,10 |
| 151 | 4+ | 9+,9 | 10,10 |
| 200 | 4+ | 10,8+ | 10,10 |
| 201 | 4+ | 10,8+ | 10,10 |
| 250 | 4+ | 10,9 | 10,10 |
| 251 | 4+ | 9+,9+ | 10,10 |
| 300 | 4+ | 9,9 | 10,10 |
| 301 | 4 | 10,10 | 10,10 |
| 350 | 4+ | 10,9+ | 10,10 |
| 351 | 4+ | 10,10 | 10,10 |
| 400 | 4 | 10,10 | 10,10 |

Table 4 shows the results of the pasteurization and the paint adhesion tests. During the coating operation, cans 3, 80, 160, 240, 320 and 399 were subjected to a temperature of about 1,000° F. for about 5 minutes. The entire surface of such cans turned a uniform brown color.

It is noted that the solution was clear during the coating of the first 100 cans. Thereafter, the coating solution became faintly hazy and was still faintly hazy when the 400th can was treated. No sludge or precipitate was isolated when the bath was centrifuged at the conclusion of the test run.

The concentrations of zirconium, available fluoride, and phosphate were determined throughout the run. The concentration of zirconium increased from an initial value of 46 ppm to 111 ppm during the run. The concentration of phosphate increased from 70 ppm to 110 ppm during the run. The concentration of available fluoride increased from 85 ppm to about 95 ppm and eventually decreased to 87 ppm.

Examples 12 through 26, as set forth in Tables 5 and 6 below, illustrate the improved ink adhesion obtained by the use of polyhydroxy compounds in the coating solution of the present invention. More specifically, Table 5 illustrates the use of various concentrations of sodium gluconate in a coating solution containing ammonium fluozirconate and/or fluotitanic acid, phosphoric acid, and hydrofluoric acid. Table 6 illustrates the results obtained by the use of polyhydroxy compounds other than sodium gluconate. In these examples, the coating solutions were applied by spraying for 15 seconds at a temperature of 90° F. and the thus coated aluminum cans were then coated with a white base polyester ink sold by Acme Printing Ink Co. as M61513 (Schlitz white). Prior to curing the ink, an alkyd-amine overvarnish was applied to the wet ink coating. Curing was effected for 6 minutes at 375° F.

Table 5

(All solutions adjusted to a pH of 2.7 with $HNO_3$)

| Ex. No. | $(NH_4)_2ZrF_6$ (g/l) | $H_2T_iF_6$ (g/l) | $H_3PO_4$ (g/l) | HF (g/l) | Sodium Gluconate (g/l) | Pasteurization Test 212° F., 15 min. | Adhesion 1% Joy, 212° F., 15 min. |
|---|---|---|---|---|---|---|---|
| 12 | 0.120 | 0 | 0.098 | 0.010 | 0 | 5,5 | 0,0 |
| 13 | 0.120 | 0 | 0.098 | 0.010 | 0.04 | 4+ | 8,8 |
| 14 | 0.120 | 0 | 0.098 | 0.010 | 0.08 | 4+ | 8,9+ |
| 15 | 0.120 | 0 | 0.098 | 0.010 | 0.195 | 4+,4+ | 9,9+ |
| 16 | 0.120 | 0 | 0.098 | 0.010 | 0.40 | 4 | 9+,9+ |
| 17 | 0.120 | 0.041 | 0.098 | 0.010 | 0 | 4,4 | 5,9 |
| 18 | 0.120 | 0.041 | 0.098 | 0.010 | 0.195 | 4,4 | 9,9+ |
| 19 | 0.120 | 0.082 | 0.098 | 0.010 | 0 | 4−,3+ | 7,9 |
| 20 | 0.120 | 0.082 | 0.098 | 0.010 | 0.195 | 3+,3+ | 9+,9+ |

Table 6

(All solutions adjusted to a pH of 2.7 with $HNO_3$)

| Ex. No. | $(NH_4)_2ZrF_6$ (g/l) | $H_3PO_4$ (g/l) | HF (g/l) | Additive (0.1 g/l) | Pasturization 212° F., 15 min. | Adhesion 1% Joy, 212° F., 15 min. |
|---|---|---|---|---|---|---|
| 21 | 0.120 | 0.098 | 0.010 | None | 4+,4+ | 0,5 |
| 22 | 0.120 | 0.098 | 0.010 | Sorbitol | 4+,4+ | 0,9+ |
| 23 | 0.120 | 0.098 | 0.010 | Mannitol | 4+,4+ | 9,9+ |
| 24 | 0.120 | 0.098 | 0.010 | Dextrose | 4+,4+ | 5,9 |
| 25 | 0.120 | 0.098 | 0.010 | Ethylene Glycol | 4+,4+ | 7,9 |
| 26 | 0.120 | 0.098 | 0.010 | Glycerine | 4+,4+ | 0,6 |

The next two groups of examples illustrate the use of prior art coating solutions containing a phosphate, flouride, and either zirconium or titanium. The examples show the undesirable results that are obtained when utilizing the coating solutions to coat aluminum. Examples C-10, C-11, C-12 and C-13 show the application of coating solutions disclosed respectively in examples 7, 9, 14 and 15 of U.S. Pat. No. 3,109,757 to aluminum cans.

For Examples C-10, C-11, C-12 and C-13, the following concentrate was prepared:

| | Percent by weight |
|---|---|
| ZnO | 8.0 |
| $H_3PO_4$ (75%) | 39.5 |
| $Ni(NO_3)_2 \cdot 6H_2O$ | 6.75 |
| $HNO_3$ (38° Be.) | 2.87 |
| $H_2O$ | 42.88 |
| | 100.00 |

The above concentrate was diluted with water to a strength of 4% by volume and had added thereto 0.25% (weight/volume) of caustic soda. There were added to the dilute solution a glycerophosphate compound and a complex metal floride in the amounts set forth in Table 7 below. The solutions were heated to about 145° F. and sprayed on aluminum cans for 30 seconds. In Example C-12, $Cu(NO_3)_2 \cdot 6H_2O$ was added in an amount to provide 0.005% copper ion.

Table 7 shows the properties of the coating solution and the coating provided thereby.

TABLE 7

| Example No. | Weight % glycerophosphate | Weight % $(NH_4)_2ZrF_6$ | Weight % $H_2TiF_6$ | Appearance of coated cans before pasteurization | Appearance of Coating Solution | Pasteurization test 212° F. 15 min | Paint Adhesion test 1% Joy, 212° F., 15 min |
|---|---|---|---|---|---|---|---|
| C-10 | 0.1 | 0.05 | 0 | light gray | white precipitate | 1 | 9+ |
| C-11 | 0.4 | 0.05 | 0 | light gray | white precipitate | 1 | 9+ |
| C-12 | 0.2 | 0 | 0.033 | dark gray | white precipitate | 0 | 9 |
| C-13 | 0.2 | 0 | 0.33 | dark gray | white precipitate | 0 | 9+ |

EXAMPLE C-14

This example shows the use of a coating solution of the type described in Example 8 of U.S. Pat. No. 2,813,814. A concentrate was prepared containing the following ingredients:

| | Grams |
|---|---|
| $MnCO_3$ | 183.4 |
| $H_3PO_4$ (75%) | 555.3 |
| $HNO_3$ (70%) | 22.5 |
| $NH_4CO_3$ | 77.3 |
| $NaHF_2$ | 6.0 |
| $K_2TiF_6$ | 15.8 |
| $H_2O$ | 573.5 |
| Total | 1433.8 |

In the above formulation, the manganese carbonate and phosphoric acid were reacted to form manganese dihydrogen phosphate. Eight hundred forty grams of the above concentrate were added to 4 liters of water. Then 44.8 g of $MnCO_3$ and 9.2 g of $NaHF_2$ were added. The solution was heated to 200° F. and sprayed for 30 seconds on an aluminum can. The coating solution contained substantial amounts of precipitate and formed a gray coating on the can. Corrosion resistance was tested by immersing the can in water at a temperature of 212° F. for 15 minutes. The can turned very dark and was rated 0. White base coat adhesion was tested by immersing the can in 1% Joy at 212° F. for 15 minutes. The can passed the adhesion test and was rated 9+.

From examples set forth above, it can be seen that the present invention provides a coating solution free of hexavalent chromium and one which is capable of forming on an aluminum surface a colorless and clear coating without modifying the appearance of the aluminum surface. The coated surface resists discoloration even after being subjected to boiling water and has excellent adhesion to overlying siccative coatings. The coating solution can be used in a continuous industrial coating operation to excellent advantage.

I claim:

1. An acidic aqueous coating solution effective in forming a non-chromate coating on aluminum and having a pH within the range of about 1.5 to about 4.0 and consisting essentially of at least about 10 ppm of zirconium or titanium or a mixture thereof, at least about 10 ppm of phosphate and available fluoride, the amounts and proportions thereof being such that said solution is capable, in the presence of dissolved aluminum, of forming on an aluminum surface a uniformly clear and colorless coating and providing a coated surface which resists blackening after the coated surface is subjected to boiling water for a 2 minute period, and wherein said solution includes dissolved aluminum and is substantially free of solids which tend to precipitate.

2. A coating solution according to claim 1 including up to 1000 ppm of phosphate.

3. A coating solution according to claim 1 wherein the available fluoride concentration is no greater than about 500 ppm.

4. A coating solution according to claim 1 wherein the pH of the solution is within the range of about 2.6 to about 3.1.

5. A coating solution according to claim 1 including fluoboric acid in an amount within the range of about 8 to about 200 ppm.

6. A coating solution according to claim 1 including at least 40 ppm of a polyhydroxy compound having no more than 6 carbon atoms.

7. A coating solution according to claim 6 wherein said polyhydroxy compound is selected from the group consisting of gluconic acid and salts thereof, sorbitol, mannitol, dextrose, ethylene glycol and glycerine.

8. A coating solution according to claim 6 including up to about 1000 ppm of said polyhydroxy compound.

9. A coating solution according to claim 1 having a pH within the range of about 2.6 to about 3.1 and comprising:

(A) about 45 to about 125 ppm of zirconium;
(B) about 50 to about 200 ppm of phosphate; and
(C) about 10 to about 200 ppm of available fluoride.

10. A coating solution according to claim 9 wherein the source of said zirconium is ammonium fluozirconate, the source of said phosphate is phosphoric acid, the source of said available fluoride includes HF and including nitric acid in an amount, as needed, to impart said pH to said solution, about 8 to about 200 ppm of fluoboric acid and about 40 to about 400 ppm of gluconic acid.

11. A process for coating an aluminum surface having a bright shiny appearance comprising contacting the surface with the coating solution of claim 10.

12. A process for coating aluminum having a bright shiny surface comprising contacting said surface with the coating solution of claim 9.

13. A process according to claim 12 wherein said solution is sprayed on said surface.

14. A process according to claim 13 wherein the temperature of said solution is within the range of about 80 to about 110° F.

15. A process according to claim 13, including subjecting the coated surface to pasteurizing conditions.

16. A coating solution according to claim 1 wherein the source of said zirconium is a fluozirconate.

17. A coating solution according to claim 1 wherein the source of said phosphate is phosphoric acid.

18. A coating solution according to claim 1 including nitric acid in an amount sufficient to impart to said solution a pH within said range.

19. A process for coating an aluminum surface comprising contacting the surface with the coating solution of claim 1.

20. A process for coating aluminum comprising contacting said aluminum with a coating solution according to claim 1 and forming thereon a coating having a weight of about 2 to about 20 mg/sq. ft.

21. A process according to claim 20 wherein the weight of coating formed is about 5 to about 10 mg/sq. ft.

22. An aqueous concentration such that an aqueous coating solution containing about 0.5 to about 10 weight percent of the concentrate is effective in forming a non-chromate coating on aluminum, has a pH within the range of about 1.5 to about 4.0 and consists essentially of:

(A) at least about 10 ppm of zirconium or titanium or a mixture thereof;
(B) about 10 ppm to about 1000 ppm of phosphate; and
(C) fluoride in an amount at least sufficient to form a complex with substantially all of said zirconium and/or titanium.

23. An aqueous concentrate according to claim 21 wherein said coating solution has a pH within the range of about 2.6 to about 3.1 and consists essentially of:

(A) about 45 to about 125 ppm of zirconium;
(B) about 50 to about 200 ppm of phosphate;
(C) about 8 to about 200 ppm of $HBF_4$;
(D) about 10 to about 50 ppm of HF; and
(E) nitric acid in an amount such that the pH of said solution is within said range.

24. An aqueous concentrate substantially free of precipitate for replenishing the coating solution of claim 1 consisting essentially of:

(A) about 5 to about 10 g/l of zirconium or about 2.5 to about 5 g/l of Ti;
(B) about 5 to about 10 g/l of phosphate; and
(C) a material which is a source of about 5 to about 20 g/l of available fluoride.

25. A concentrate according to claim 24 wherein said source of available fluoride is HF or ammonium bifluoride or a mixture thereof.

26. An acidic aqueous coating solution effective in forming a non-chromate coating on aluminum and consisting essentially of:

(A) about 20 to about 65 ppm of titanium;
(B) about 50 to about 200 ppm of phosphate; and
(C) about 10 to about 200 ppm of available fluoride;

wherein said solution is capable, in the presence of dissolved aluminum, of forming on an aluminum surface a uniformly clear and colorless coating and providing a coated surface which resists blackening after the coated surface is subjected to boiling water for a 2 minute period, and wherein said solution includes dissolved aluminum and is substantially free of solids which tend to precipitate.

27. A process for coating an aluminum surface having a bright shiny appearance comprising contacting the surface with the coating solution of claim 26.

28. An acidic aqueous coating solution effective in forming a non-chromate coating on aluminum and having a pH within the range of about 1.5 to about 4.0 and consisting essentially of:

(A) about 10 to about 125 ppm of zirconium;

(B) about 10 to about 1000 ppm of phosphate; and (C) about 10 to about 500 ppm of available fluoride; wherein said coating solution is substantially free of precipitate.

29. A solution according to claim 28 wherein the source of said zirconium is ammonium fluozirconate, wherein the source of said phosphate is phosphoric acid and the source of said available fluoride is HF or $NH_4F.HF$.

30. A process for coating an aluminum surface having a bright shiny appearance comprising contacting the surface with the coating solution of claim 29.

31. A solution according to claim 28 including about 8 to about 200 ppm of fluoboric acid.

32. A solution according to claim 31 including about 40 to about 400 ppm of gluconic acid.

33. A process for coating an aluminum surface having a bright shiny appearance comprising contacting the surface with the coating solution of claim 31.

34. A coating solution according to claim 28 having a pH within the range of about 2.6 to about 3.1 and consisting essentially of:

(A) about 45 to about 125 ppm of zirconium;

(B) about 50 to about 200 ppm of phosphate;

(C) about 10 to about 200 ppm of available fluoride.

35. A process for coating an aluminum surface having a bright shiny appearance comprising contacting the surface with the coating solution of claim 34.

36. A solution according to claim 34 wherein the source of said zirconium is ammonium fluozirconate, wherein the source of said phosphate is phosphoric acid and the source of said available fluoride is HF or $NH_4F.HF$.

37. A solution according to claim 36 including about 8 to about 200 ppm of fluoboric acid.

38. A solution according to claim 37 including about 40 to about 400 ppm of gluconic acid.

39. A process for coating an aluminum surface having a bright shiny appearance comprising contacting the surface with the coating solution of claim 38.

40. A process for coating an aluminum surface having a bright shiny appearance comprising contacting the surface with the coating solution of claim 37.

41. A process for coating an aluminum surface having a bright shiny appearance comprising contacting the surface with the coating solution of claim 36.

42. A process for coating an aluminum surface having a bright shiny appearance comprising contacting the surface with the coating solution of claim 28.

43. An acidic aqueous coating solution effective in forming a non-chromate coating on aluminum and having a pH within the range of about 1.5 to about 4.0 and consisting essentially of:

(A) at least about 10 ppm of zirconium;

(B) about 10 to about 1000 ppm of phosphate; and (C) about 10 to about 500 ppm of available fluoride; wherein the amount of zirconium in the solution is not in excess of its solubility limit in the solution, and wherein said coating solution is substantially free of precipitate.

44. A process for coating an aluminum surface having a bright shiny appearance comprising contacting the surface with the coating solution of claim 43.

* * * * *

UNITED STATES PATENT AND TRADEMARK OFFICE

CERTIFICATE OF CORRECTION

PATENT NO. : 4,148,670
DATED : April 10, 1979
INVENTOR(S) : Timm L. Kelly

It is certified that error appears in the above-identified patent and that said Letters Patent are hereby corrected as shown below:

Column 1, line 68, "chromatic" should read -- chromic --.

Column 9, line 24, "fluozironate" should read -- fluozirconate --.

Column 9, lines 55-56, the sentence reading "This may be replenished as the ingredients are depleted" should be deleted.

Column 10, line 65, "have" should read -- having --.

Column 11, line 44, insert a comma (,) after "Thereafter".

Column 18, line 41, "21" should read -- 22 --.

Signed and Sealed this

*Eighth* Day of *April 1980*

[SEAL]

*Attest:*

SIDNEY A. DIAMOND

*Attesting Officer*

*Commissioner of Patents and Trademarks*